US011310588B2

(12) United States Patent
Makinen et al.

(10) Patent No.: US 11,310,588 B2
(45) Date of Patent: Apr. 19, 2022

(54) AUDIO PROCESSING

(71) Applicant: Nokia Technologies Oy, Espoo (FI)

(72) Inventors: Toni Makinen, Pirkkala (FI); Miikka Vilermo, Siuro (FI); Mikko Tammi, Tampere (FI); Jussi Virolainen, Espoo (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 17/092,402

(22) Filed: Nov. 9, 2020

(65) Prior Publication Data

US 2021/0144467 A1 May 13, 2021

(30) Foreign Application Priority Data

Nov. 11, 2019 (GB) ..... 1916335

(51) Int. Cl.
*H04R 3/00* (2006.01)
*H04R 1/32* (2006.01)

(52) U.S. Cl.
CPC ..... *H04R 1/32* (2013.01)

(58) Field of Classification Search
CPC ..... H04R 1/32; H04R 1/326; H04R 1/30
USPC ..... 381/92, 122
See application file for complete search history.

(56) References Cited

U.S. PATENT DOCUMENTS

| | | | | |
|---|---|---|---|---|
| 2002/0131580 | A1 | 9/2002 | Smith | |
| 2005/0195988 | A1 | 9/2005 | Tashev et al. | 381/92 |
| 2008/0170718 | A1* | 7/2008 | Faller | H04R 3/005 381/92 |
| 2017/0318387 | A1 | 11/2017 | Ray | |
| 2017/0374453 | A1 | 12/2017 | Tawada | |

FOREIGN PATENT DOCUMENTS

| | | | |
|---|---|---|---|
| CN | 106576204 | A | 4/2017 |
| CN | 110140359 | A | 8/2019 |
| EP | 3 089 476 | A1 | 11/2016 |
| WO | WO 2014/162171 | A1 | 10/2014 |

* cited by examiner

*Primary Examiner* — Ammar T Hamid
(74) *Attorney, Agent, or Firm* — Harrington & Smith

(57) ABSTRACT

An audio processing technique including obtaining a multi-channel audio signal, a first sound direction of interest and a second sound direction of interest; determining, for one or more frequency bands, a respective first range of sound directions encompassed by a first focus pattern directed to said first sound direction of interest and a respective second range of sound directions encompassed by a second focus pattern directed to said second sound direction of interest; determining, for said one or more frequency bands, respective overlap between the first and second ranges of sound directions; and deriving, based on the multi-channel audio signal and in accordance with said first and second focus patterns, a processed audio signal where sounds in said first and second sound directions of interest are emphasized in relation to sounds in other sound directions, said derivation including controlling emphasis in dependence of the determined overlap.

20 Claims, 5 Drawing Sheets

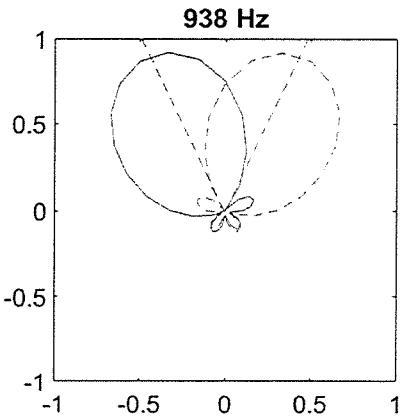
Fig.5A
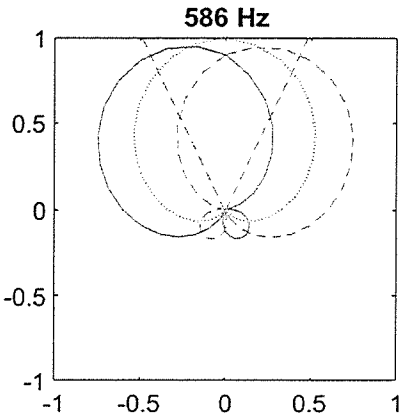
Fig.5B
Fig.5C
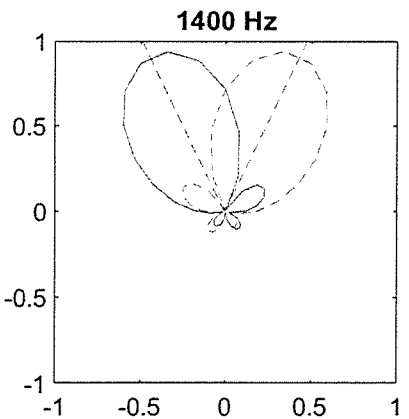
Fig.5D
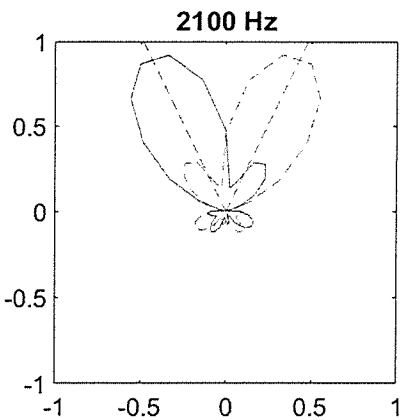
Fig.5E
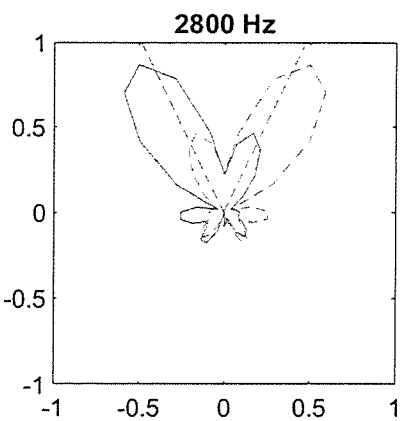
Fig.5F

AUDIO PROCESSING

TECHNICAL FIELD

The example and non-limiting embodiments of the present invention relate to processing of audio signals. In particular, various example embodiments of the present invention relate to audio processing that involves deriving a processed audio signal where sounds in one or more sound directions of a spatial audio image represented by a multi-channel audio signal are emphasized in relation to sounds in other sound directions.

BACKGROUND

With the development of microphone technologies and with increase in processing power and storage capacity available in mobile devices, many mobile devices, such as mobile phones, tablet computers, laptop computers, digital cameras, etc. are nowadays provided with microphone arrangements that enable capturing multi-channel audio. Typically, the process of capturing a multi-channel audio signal using the mobile device comprises operating a microphone array arranged in the mobile device to capture a plurality of microphone signals and processing the captured microphone signals into a recorded multi-channel audio signal for further processing in the mobile device, for storage in the mobile device and/or for transmission to one or more other devices. Typically, although not necessarily, the multi-channel audio is captured together with the associated video.

Capturing multi-channel audio that represents an audio scene around the mobile device provides interesting possibilities for processing the captured multi-channel audio during the capture and/or after the capture. As an example in this regard, upon or after capturing the multi-channel audio signal that represents the audio scene around the mobile device, a user may wish to apply audio focusing to emphasize sounds in some sound directions in relation to sounds in other sound directions. A typical solution for audio focusing to emphasize sound in a desired sound direction involves audio beamforming, which is a technique well known in the art. Other techniques for accomplishing an audio focusing to a direction of interest include, for example, the one described in [1]. In the present disclosure, the terms audio focusing, audio beamforming or beamforming in general are interchangeably used to describe a technique that involves emphasizing sounds in certain sound directions in relation to sounds in other sound directions.

In the audio beamforming, the multi-channel audio signal obtained from the microphone array represents sounds captured in a range of sound directions with respect to the microphone array, whereas a beamformed audio signal resulting from the audio beamforming represents sounds in a certain sound direction or in a certain sub-range of sound directions with respect to the microphone array. In this disclosure, we refer to the range of sound directions as a spatial audio image captured at the position of the microphone array, whereas the beamformed audio signal may be considered to represent a certain sound direction or a certain sub-range of sound directions within the spatial audio image.

In audio beamforming, a desired sound direction within the spatial audio image may be defined as an (azimuth) angle with respect to a reference direction. The reference direction is typically, but not necessarily, a direction directly in front of the assumed listening point. The reference direction may be defined as 0° (i.e. zero degrees), whereas a sound direction that is to the left of the reference direction may be indicated by a respective angle in the range $0° < \alpha \leq 180°$ and a sound direction that is to the right of the reference direction may be indicated by a respective angle in the range $-180° \leq \alpha < 0°$. with directions at 180° and −180° indicating a sound direction opposite to the reference direction.

While in principle the aim of the beamforming is to extract or derive a beamformed audio signal that represents sounds in the certain sound direction or in a certain sub-range of sound directions without representing sounds in other sound directions, in a practical implementation isolation of sounds in a certain sound direction or in a certain sub-range of sound directions while completely excluding sounds in other directions is typically not possible. Instead, in practice the beamformed audio signal is typically an audio signal where sounds in a certain sound direction or in a certain sub-range of sound directions are emphasized in relation to sounds in other sound directions. Consequently, even if an audio beamforming procedure aims at a beamformed audio signal that only represents sounds in a certain sound directions, the resulting beamformed audio signal is one where sounds in the desired sound directions and sounds in a sub-range of directions around the desired sound direction are emphasized in relation to sounds in other directions in accordance with characteristics of a beam applied for the audio beamforming.

The width or shape of the beam may be indicated by a solid angle (typically in horizontal direction only), which defines a sub-range of sound directions around a sound direction of (primary) interest that are considered to fall within the beam. As an example in this regard, the solid angle may define a sub-range of sound directions around the sound direction of interest such that sounds in sound directions outside the solid angle are attenuated at least a predefined amount in relation to a sound direction of maximum amplification (or minimum attenuation) within the solid angle. The predefined amount may be set, for example to 6 dB or 3 dB. However, definition of the beam as the solid angle is a simplified model for indicating the width or shape of the beam and hence the sub-range of sound directions encompassed by the beam when targeted to the sound direction of interest, whereas in real life implementation the beam does not strictly cover a well-defined range of sound directions around the sound direction of interest but the beam rather has a width and shape that varies with the sound direction of interest and/or with audio frequency. Throughout this disclosure, the sound direction of interest may be also referred to as a beam direction.

In a straightforward audio capture scenario the audio beamforming is carried out using a single beam (to capture sounds in a single desired sound direction) and these well-known limitations in practical implementation of the audio beamforming do not significantly degrade the resulting beamformed audio signal and/or they may be accounted for via suitable post-processing techniques. However, in a scenario where two or more beams are applied to capture sounds in respective two or more sound directions the audio-frequency-and-sound-direction dependent shape of the beam typically results in compromised quality of the beamformed audio signal, especially in scenarios where two sound directions of interest are relatively close to each other and hence the respective beams may overlap at least in some parts of the frequency spectrum. Consequently, the frequency response of the beamformed audio signal may be severely distorted in frequency sub-bands where the overlap occurs, typically resulting in perceptually unnatural, unclear and/or unintelligible audio content due to unintended boosting or suppression of lower frequencies that in case of harmonic sounds also extends to higher frequencies.

REFERENCES

[1] WO 2014/162171 A1

SUMMARY

According to an example embodiment, a method for audio processing is provided, the method comprising: obtaining a multi-channel audio signal, a first sound direction of interest and a second sound direction of interest; determining, for one or more frequency bands, a respective first range of sound directions encompassed by a first focus pattern directed to said first sound direction of interest and a respective second range of sound directions encompassed by a second focus pattern directed to said second sound direction of interest; determining, for said one or more frequency bands, respective overlap between the first and second ranges of sound directions; and deriving, based on the multi-channel audio signal and in accordance with said first and second focus patterns, a processed audio signal where sounds in said first and second sound directions of interest are emphasized in relation to sounds in other sound directions, said derivation comprising controlling emphasis in said first and second ranges of sound directions in dependence of the determined overlap.

According to another example embodiment, an apparatus for audio processing is provided, the apparatus configured to: obtain a multi-channel audio signal, a first sound direction of interest and a second sound direction of interest; determine, for one or more frequency bands, a respective first range of sound directions encompassed by a first focus pattern directed to said first sound direction of interest and a respective second range of sound directions encompassed by a second focus pattern directed to said second sound direction of interest; determine, for said one or more frequency bands, respective overlap between the first and second ranges of sound directions; and derive, based on the multi-channel audio signal and in accordance with said first and second focus patterns, a processed audio signal where sounds in said first and second sound directions of interest are emphasized in relation to sounds in other sound directions, said derivation comprising controlling emphasis in said first and second ranges of sound directions in dependence of the determined overlap.

According to another example embodiment, an apparatus for audio processing is provided, the apparatus comprising: a means for obtaining a multi-channel audio signal, a first sound direction of interest and a second sound direction of interest; a means for determining, for one or more frequency bands, a respective first range of sound directions encompassed by a first focus pattern directed to said first sound direction of interest and a respective second range of sound directions encompassed by a second focus pattern directed to said second sound direction of interest; a means for determining, for said one or more frequency bands, respective overlap between the first and second ranges of sound directions; and a means for deriving, based on the multi-channel audio signal and in accordance with said first and second focus patterns, a processed audio signal where sounds in said first and second sound directions of interest are emphasized in relation to sounds in other sound directions, said derivation comprising controlling emphasis in said first and second ranges of sound directions in dependence of the determined overlap.

According to another example embodiment, an apparatus for audio processing is provided, wherein the apparatus comprises at least one processor; and at least one memory including computer program code, which, when executed by the at least one processor, causes the apparatus to: obtain a multi-channel audio signal, a first sound direction of interest and a second sound direction of interest; determine, for one or more frequency bands, a respective first range of sound directions encompassed by a first focus pattern directed to said first sound direction of interest and a respective second range of sound directions encompassed by a second focus pattern directed to said second sound direction of interest; determine, for said one or more frequency bands, respective overlap between the first and second ranges of sound directions; and derive, based on the multi-channel audio signal and in accordance with said first and second focus patterns, a processed audio signal where sounds in said first and second sound directions of interest are emphasized in relation to sounds in other sound directions, said derivation comprising controlling emphasis in said first and second ranges of sound directions in dependence of the determined overlap.

According to another example embodiment, a computer program for audio focusing is provided, the computer program comprising computer readable program code configured to cause performing at least a method according to the example embodiment described in the foregoing when said program code is executed on a computing apparatus.

The computer program according to an example embodiment may be embodied on a volatile or a non-volatile computer-readable record medium, for example as a computer program product comprising at least one computer readable non-transitory medium having program code stored thereon, the program which when executed by an apparatus cause the apparatus at least to perform the operations described hereinbefore for the computer program according to an example embodiment of the invention.

The exemplifying embodiments of the invention presented in this patent application are not to be interpreted to pose limitations to the applicability of the appended claims. The verb "to comprise" and its derivatives are used in this patent application as an open limitation that does not exclude the existence of also unrecited features. The features described hereinafter are mutually freely combinable unless explicitly stated otherwise.

Some features of the invention are set forth in the appended claims. Aspects of the invention, however, both as to its construction and its method of operation, together with additional objects and advantages thereof, will be best understood from the following description of some example embodiments when read in connection with the accompanying drawings.

BRIEF DESCRIPTION OF FIGURES

The embodiments of the invention are illustrated by way of example, and not by way of limitation, in the figures of the accompanying drawings, where

FIGS. 5A through 5F schematically illustrate frequency dependency of beam patterns and spatial overlap therebetween as a function of frequency according to an example;

DESCRIPTION OF SOME EMBODIMENTS

Figure 1:
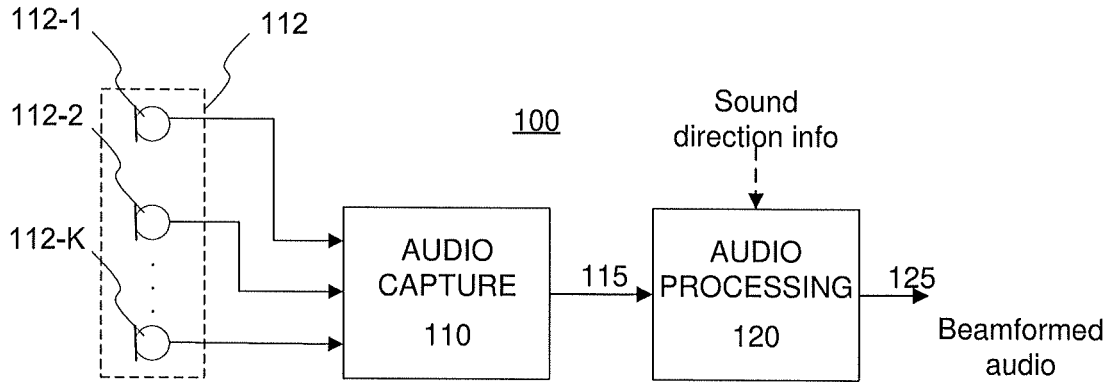
FIG. 1 illustrates a block diagram of some components and/or entities of an audio processing arrangement according to an example.

FIG. 1 illustrates a block diagram of some components and/or entities of an audio processing arrangement 100 according to a non-limiting example. The audio processing arrangement 100 comprises an audio capturing entity 110 and an audio processing entity 120. The audio capturing entity 110 is coupled to a microphone array 112 and it is arranged to receive respective microphone signals from a plurality of microphones 112-1, 112-2, . . . , 112-K and to record a captured multi-channel audio signal 115 based on the received microphone signals. The microphones 112-1, 112-2, . . . , 112-K represent a plurality of (i.e. two or more) microphones, where an individual one of the microphones may be referred to as a microphone 112-*k*. Herein, the concept of microphone array 112 is to be construed broadly, encompassing any arrangement of two or more microphones 112-*k* arranged in or coupled to a device implementing the audio processing arrangement 100.

Each of the microphone signals provides a different representation of the captured sound, which difference depends on the positions of the microphones 112-*k* with respect to each other. For a sound source in a certain spatial position with respect to the microphone array 112, this results in a different representation of sounds originating from the certain sound source in each of the microphone signals: a microphone 112-*k* that is closer to the certain sound source captures the sound originating therefrom at a higher amplitude and earlier than a microphone 112-*j* that is further away from the certain sound source. Together with the knowledge regarding the positions of the microphones 112-*k* with respect to each other, such differences in amplitude and/or time delay enable application of an audio beamforming procedure to derive the beamformed audio signal 125 based on the microphone signals and/or on the multi-channel audio signal 115.

The audio processing entity 120 may be arranged to carry out an audio beamforming procedure based on the multi-channel audio signal 115 obtained from the audio capturing entity 110 in dependence of sound direction information indicated thereto, thereby deriving a beamformed audio signal 125 based on the multi-channel audio signal 115. The audio processing entity 120 may be further arranged to control at least some aspects of operation of the audio capturing entity 110 to record the multi-channel audio signal 115 based on the microphone signals captured by the microphone array 112.

According to an example, the microphone signals captured by the microphone array 112 may be applied as the multi-channel audio signal 115. In another example, the audio capturing entity 110 may be arranged to, possibly under control of the audio processing entity 120, derive the multi-channel audio signal 115 based on the microphone signals captured by the microphone array 112. In this regard, the audio capturing entity 110 may be arranged to provide the multi-channel audio signal 115 in a predefined spatial audio format or in a spatial audio format indicated by the audio processing entity 120. Non-limiting examples of applicable spatial audio formats include an Ambisonic (spherical harmonic) audio format and various multi-loudspeaker audio formats (such as 5.1-channel or 7.1. surround sound) known in the art. The multi-channel audio signal 115 may be accompanied by metadata that includes information that defines the applied audio format and/or channel configuration information that serves to define the relationship between the channels of the multi-channel audio signal 115, e.g. the respective positions and/or orientations of the microphones 112-*k* of the microphone array 112 (with respect to a reference position/orientation and/or with respect to other microphones 112-*k* of the microphone array 112) applied to capture the microphone signals serving as basis for the multi-channel audio signal 115. In an example, additionally or alternatively, the metadata may comprise parametric data describing the spatial audio field, such as respective sound direction-of-arrival estimates, respective ratios between direct and ambient sound energy components, etc. for one or more frequency (sub-)bands.

The sound direction information provided as input to the audio processing entity 120 may indicate one or more sound directions of interest. Along the lines described in the foregoing, for each indicated sound direction of interest, the audio beamforming procedure in the audio processing entity 120 may result in a respective audio signal component for derivation of the beamformed audio signal 125, which audio signal component aims at representing sounds in the respective sound direction of interest without representing sounds in other sound directions (e.g. aims at isolating sound in the respective sound direction of interest), whereas the beamformed audio signal 125 is derived as a combination (e.g. a sum or an average) of the respective audio signal components representing the one or more sound directions of interest. As further described in the foregoing, in a practical implementation a respective audio signal component for the beamformed audio signal 125 is one in which sounds in the respective sound direction of interest together with sounds in sound directions close to the respective sound direction of interest are emphasized in relation to sounds in other sound directions in accordance with spatial characteristics of a beam applied for the audio beamforming. Audio beamforming techniques that are as such applicable in the audio processing entity 120 for derivation of a respective audio signal component representing a single direction of interest are well known in the art and they are described in further detail in the present disclosure only to an extent necessary for understanding certain aspects of the audio beamforming technique disclosed herein.

Figure 2A:
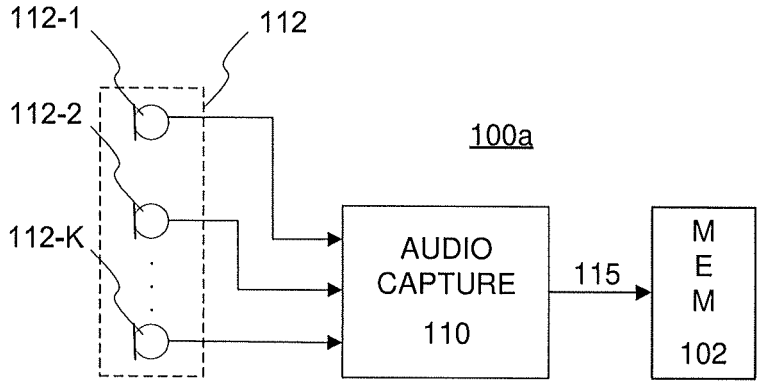
FIGS. 2A and 2B illustrate respective block diagrams of some components and/or entities of an audio processing sub-system according to an example.
Figure 2B:
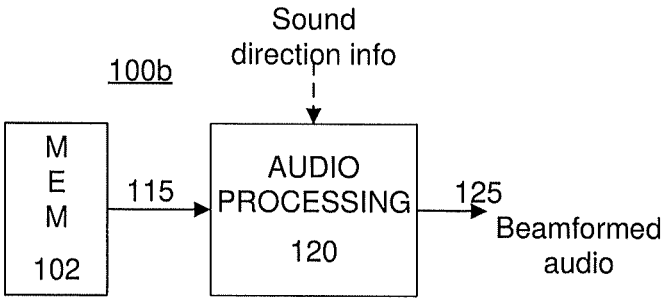

FIGS. 2A and 2B illustrate respective block diagrams of some components of respective audio processing sub-systems 100*a* and 100*b* according to a non-limiting example. The audio processing sub-system 100*a* comprises the microphone array 112 and the audio capturing entity 110 described in the foregoing t-ogether with a memory 102. A difference to operation of the audio processing arrangement 100 is that instead of providing the multi-channel audio signal 115 (directly) to the audio processing entity 120 for the audio beamforming procedure therein the audio capturing entity 110 stores the multi-channel audio signal 115 in the memory 102 for subsequent access by the audio processing entity 120. In this regard, the multi-channel audio signal 115 may be stored in the memory 102, possibly together with the metadata, which may include information that indicates the audio format applied for the multi-channel audio signal 115 and/or channel configuration information that serves to define the relationship between the channels of the multi-channel audio signal 115, as described in the foregoing.

The audio processing sub-system 100*b* comprises the memory 102 and the audio processing entity 120 described in the foregoing. Hence, a difference in operation of the audio processing sub-system 100*b* in comparison to a corresponding aspect of operation of the audio processing arrangement 100 is that instead of (directly) obtaining the multi-channel audio signal 115 from the audio capturing entity 110, the audio processing entity 120 reads the multi-channel audio signal 115, possibly together with the metadata, from the memory 102.

In the example provided via respective illustrations of FIGS. 2A and 2B, the memory 102 read by the audio processing entity 120 is the same one to which the audio capturing entity 110 stores the multi-channel audio signal 115 recorded or derived based on the respective microphone signals obtained from the microphones 112-*k* of the microphone array 112. As an example, such an arrangement may be provided by providing the audio processing sub-systems 100*a* and 100*b* in a single device that also includes (or otherwise has access to) the memory 102. In another example in this regard, the audio processing sub-systems 100*a* and 100*b* may be provided in a single device or in two separate devices and the memory 102 may comprise a memory provided in a removable memory device such as a memory card or a memory stick that enables subsequent access to the multi-channel audio signal 115 (possibly together with the metadata) in the memory 102 by the same device that stored this information therein or by another device.

In another variation of the example provided via respective illustrations of FIGS. 2A and 2B, the memory 102 may be provided in a further device, e.g. in a server device, that is communicatively coupled to a device providing the both audio processing sub-systems 100*a*, 100*b* or to respective devices providing the audio processing sub-system 100*a* and the audio processing sub-system 100*b* by a communication network. In a further variation of the example provided via respective illustrations of FIGS. 2A and 2B, the memory 102 may be replaced by a transmission channel or by a communication network that enables transferring the multi-channel audio signal 115 (possibly together with the metadata) from a first device providing the audio processing sub-system 100*a* to a second device providing the audio processing sub-system 100*b*. In this regard, the transfer of the multi-channel audio signal 115 may be transmitted/received as an audio packet stream, whereas the audio capturing entity 110 may further operate to encode the multi-channel audio signal 115 for encoded audio data suitable for transmission in the audio packet stream and the audio processing entity 120 may further operate to decode the encoded audio data received in the audio packet stream into the multi-channel audio signal 115 (or into a reconstructed version thereof) for the audio beamforming procedure therein.

The audio beamforming procedure in the audio processing entity 120 aims at providing the beamformed audio signal 125 based on the multi-channel audio signal 115 such that sounds in each of the one or more directions of interest are emphasized in relation to sounds in other sound directions of the spatial audio image represented by the multi-channel audio signal 115. In case the sound direction information comprises a single sound direction of interest, the audio beamforming procedure in the audio processing entity 120 may be carried out using a suitable audio beamforming technique known in the art. In contrast, in case the sound direction information comprises multiple (i.e. two or more) sound direction of interest, the audio beamforming procedure in the audio processing entity 120 may be carried out as described in the following via a number of non-limiting examples. Before proceeding into describing specific examples pertaining to aspects of the audio beamforming procedure a brief overview of some further aspects pertaining to audio beamforming techniques in general and/or some characteristics of beams applicable for deriving the individual audio signal component for derivation of the beamformed audio signal 125 are provided to facilitate understanding various aspects of the audio beamforming technique according to the present disclosure.

In general, audio beamforming techniques may be divided into two classes, i.e. fixed beamforming techniques and adaptive beamforming techniques. The fixed beamforming techniques are independent of characteristics of a multi-channel audio signal on which the beamforming is based, whereas the adaptive beamforming techniques adapt to characteristics and/or variations of the multi-channel audio signal on which the beamforming is based. Beamforming techniques applied for a frequency-domain signal are in many scenarios especially suitable for audio beamforming based on the multi-channel audio signal 115 captured using a device of small size, such as a mobile phone or a digital cameras, where the microphones 112-*k* of the microphone array 112 are typically relatively close to each other due to limited space available therefor in the device, which typically results in inaccurate computation due to limitations in sampling frequency. Moreover, a device of small size typically also imposes limitations to the number of microphones 112-*k* included in the microphone array 112, which typically results in limitations in applicable beamforming frequency range of a practical implementation of the audio processing arrangement 100, the audio processing sub-system 100*a* and/or the audio processing sub-system 100*b*. Consequently, it may be advantageous to control the beamforming frequency range limits separately for a number of frequency sub-bands or frequency bins instead of carrying out the audio beamforming for a time segment of the multi-channel audio signal 115 in time domain, which substantially implies a single audio beamforming procedure carried out for the whole frequency spectrum.

As an example, audio beamforming in a frequency domain may comprise using respective complex-valued beam coefficients to process, e.g. to multiply, individual channels of the multi-channel audio signal 115 and deriving the beamformed audio signal 125 as a combination (e.g. a sum or an average) of the processed individual channels. Frequency-domain audio beamforming is applicable in both fixed beamforming and adaptive beamforming: in the former case the complex-valued beam coefficients are predefined ones, whereas in the latter case the complex-valued beam coefficients are adaptive ones, defined as part of the audio beamforming procedure. Various techniques for computing the beam coefficients (for the fixed or adaptive beamforming) are known in the art and spatial characteristics of a beam pattern achievable via usage of a given audio beamforming technique depends on characteristics of the microphone array 112 (e.g. the number of microphones 112-*k* and/or distances between the microphones 112-*k*) applied in capturing the multi-channel audio signal 115 serving as the basis for the audio beamforming procedure. In short, as briefly described in the foregoing, the distances between the microphones 112-*k* define physical limitations to the applicable beamforming frequency range within the range of sound directions represented by the spatial audio image, whereas the number of microphones 112-*k* affects spatial characteristics of the achievable beam patterns within the range of sound directions represented by the spatial audio image.

Figure 3:
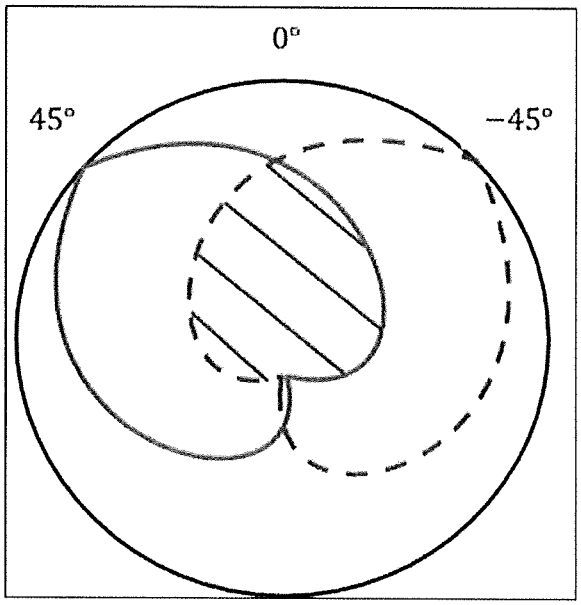
FIG. 3 schematically illustrates an example of two simultaneous beam patterns directed at different sound directions interfering with each other.

Considering a scenario with two sound directions of interest that, consequently, requires usage of two respective beam patterns directed at the two sound directions of interest for the same time segment of the multi-channel audio signal 115, there is a risk of the two beam patterns interfering each other, especially at low frequencies of the audio spectrum where the beam patterns are typically significantly wider than at high(er) frequencies of the audio spectrum. A non-limiting example schematically illustrating a scenario with a first sound direction of interest at +45° and a second sound direction of interest at −45° is depicted in FIG. 3. Therein, a circle represents a range of sound directions covering the range from −180° to 180°, the solid curve represents a spatial coverage of a first beam pattern that is directed to the first sound direction of interest at +45°, the dashed curve represents a spatial coverage of a second beam pattern that is directed to the second sound direction of interest at −45°, and the hatched part of the illustration indicates the overlapping portion of respective spatial coverages of the first and second beam patterns. Hence, even though the two sound directions of interest are 90° apart from each other, there is nevertheless a significant spatial overlap between the respective spatial coverages of the first and second beam patterns and, consequently, in addition to emphasizing sounds at +45° and −45° the resulting beamformed audio signal would also provide a significant unintentional emphasis for sound at 0° (i.e. directly in front).

As described in the foregoing, the shape and hence the spatial coverage of the beam patterns varies across audio frequencies represented in the multi-channel audio signal 115, typically such that the spatial coverage decreases with increasing audio frequency (and thereby also the solid angle that may be applied to define the width of the beam pattern at a given frequency decreases with increasing audio frequency). Consequently, in one scenario the spatial overlap is more significant in lower audio frequencies than in high audio frequencies, thereby resulting a higher likelihood of and/or more severe audio degradation at the lower audio frequencies than in the higher audio frequencies. In another scenario, the spatial overlap may only exist at lower audio frequencies, thereby resulting in audio degradation only at the lower audio frequencies while higher audio frequencies may be reproduced undisturbed. Moreover, the shape of the beam pattern may also change as a function of sound direction, e.g. such that the shape of the beam pattern may be significantly different in sound directions at or close to the reference direction (e.g. the front direction) from that achievable further away from the reference direction (e.g. in sound directions at or close to +90° and −90°.

The extent of spatial overlap between the respective beam patterns in a scenario that involves two sound directions of interest at different audio frequencies and at different distances (of differences) between the two sound directions of interest is further schematically illustrated via respective non-limiting conceptual examples depicted in illustrations FIGS. 4A to 4D. In each of these illustrations the horizontal axis represents a beam direction (selected in accordance with the respective sound direction of interest) and the vertical axis represents an audio frequency. Moreover, in each of these illustrations the first sound direction of interest is indicated as $\alpha_1$ and the second sound direction of interest is indicated as $\alpha_2$, while a first beam pattern directed towards the first sound direction of interest $\alpha_1$ is shown as a solid curve and a second beam pattern directed towards the second sound direction of interest $\alpha_2$ is shown as a dashed curve. In the following, for brevity and clarity of the description, the first and second directions of interest $\alpha_1$, $\alpha_2$ may be referred to, respectively, as first and second beam directions.

Figure 4A:
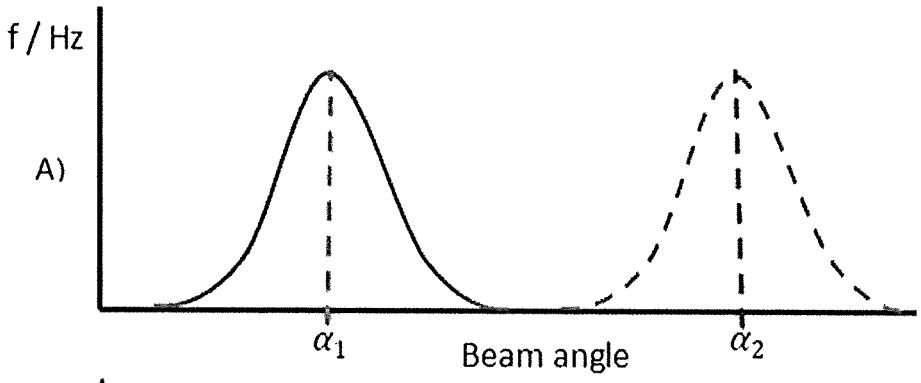
FIGS. 4A through 4D schematically illustrate spatial overlap between two beam patterns at different distances from each other at different frequencies according to an example.

The illustration of FIG. 4A depicts a first scenario, where the difference between the first and second beam directions $\alpha_1$, $\alpha_2$ is large enough to result in a situation where the first and second beam patterns are spatially non-overlapping across the range of audio frequencies. Consequently, in the first scenario the audio beamforming procedure in the audio processing entity 120 may be carried out separately for the first and second beam directions $\alpha_1$, $\alpha_2$ without a risk of audio degradation due to overlapping beam patterns. This may comprise, for example, applying the first beam pattern to the multi-channel audio signal 115 to derive a first audio signal component, applying the second beam pattern to the multi-channel audio signal 115 to derive a second audio signal component, and deriving the beamformed audio signal 125 as a combination (e.g. as a sum or as an average) of the first and second audio signal components.

Figure 4B:
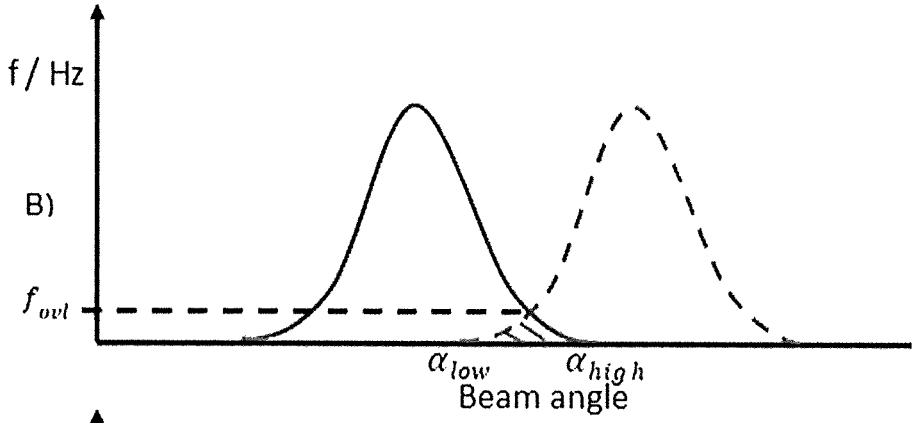

The illustration of FIG. 4B depicts a second scenario, where the difference between the first and second beam directions $\alpha_1$, $\alpha_2$ may be smaller than that of the first scenario to an extent that the first and second beam patterns spatially overlap at audio frequencies below a first threshold frequency $f_{ovl}$ such that the spatial overlap between the first and second beam patterns does not encompass both the first beam direction $\alpha_1$ and the second beam direction $\alpha_2$ at any frequency, while the first and second beam patterns are spatially non-overlapping at audio frequencies above the first threshold frequency $f_{ovl}$. The first threshold frequency $f_{ovl}$ is dependent at least on respective shapes of the first and second beam patters and on the difference between the first and second beam directions $\alpha_1$, $\alpha_2$ (e.g. on $|\alpha_1-\alpha_2|$), whereas it may be further dependent on one or both of the first and second beam directions $\alpha_1$, $\alpha_2$ (e.g. on the difference between the first beam direction $\alpha_1$ and the reference direction and/or on the difference between the second beam direction $\alpha_2$ and the reference direction) due to possible beam-direction-dependency of the beam shape. The extent of spatial overlap below the first threshold frequency $f_{ovl}$ is frequency-dependent, typically such that the extent of spatial overlap decreases with increasing frequency. The spatial overlap may be indicted, for example, as a range (or set) of overlapping sound directions at a given frequency $f<f_{ovl}$, which range extends over directions from $\alpha_{lo}(f)$ to $\alpha_{hi}(f)$. Moreover, in the second scenario the spatial overlap at any frequency $f<f_{ovl}$ does not encompass the first beam direction $\alpha_1$ or the second beam direction $\alpha_2$, i.e. both the first beam direction $\alpha_1$ and the second beam direction $\alpha_2$ are outside the overlap range between $\alpha_{low}=\min(\alpha_{lo}(f))$ and $\alpha_{high}=\max(\alpha_{hi}(f))$. In yet another words, despite the spatial overlap below the first threshold frequency $f_{ovl}$, the first beam pattern does not encompass the second beam direction $\alpha_2$ and the second beam pattern does not encompass the first beam direction $\alpha_1$ at any of the audio frequencies.

Consequently, in the second scenario the audio beamforming procedure in the audio processing entity 120 may be carried out separately for the first and second beam directions $\alpha_1$, $\alpha_2$ without a risk of audio degradation due to overlapping beam patterns above the first threshold frequency $f_{ovl}$, whereas the emphasis at frequencies below the first threshold frequency $f_{ovl}$ due to the spatial overlap between the first and second beam patterns is to be compensated for to mitigate or completely eliminate audio degradation that might otherwise occur in these frequencies. This may comprise, for example, applying the first beam pattern to the multi-channel audio signal 115 to derive a first audio signal component, applying the second beam pattern to the multi-channel audio signal 115 to derive a second audio signal component, deriving the beamformed audio signal 125 as a combination (e.g. as a sum or as an average) of the first and second audio signal components, and applying a compensation procedure to the beamformed audio signal 125. The compensation procedure may comprise, for example, attenuating the beamformed audio signal 125 at one or more frequencies below the first threshold frequency $f_{ovl}$, for example via application of a respective compensation gain, where the compensation gain for a given frequency is set to a value that is inversely proportional to the extent of spatial overlap at the given frequency (e.g. an inverse of a measure of spatial overlap at the given frequency). As an example in this regard, the compensation may be provided via application of a spatial post-filter described in [1] to the beamformed audio signal 125.

In the above description pertaining to the second scenario, the first and second beam patterns implicitly spatially overlap at all audio frequencies below a first threshold frequency $f_{ovl}$ while the first and second beam patterns are spatially non-overlapping at audio frequencies above the first threshold frequency $f_{ovl}$. However, the second scenario generalizes into one where the spatial overlap concerns only some audio frequencies below the first threshold frequency $f_{ovl}$ or, conversely, there is no spatial overlap in some audio frequencies below the first threshold frequency $f_{ovl}$. In such a variation of the second scenario, the compensation procedure is applied to those frequencies below the first threshold frequency $f_{ovl}$ where spatial overlap occurs, whereas those frequencies below the first threshold frequency $f_{ovl}$ at which no spatial overlap occurs are processed as described in the foregoing in context of the second scenario for the audio frequencies above the first threshold frequency $f_{ovl}$ (i.e. without application of the compensation procedure).

Figure 4C:
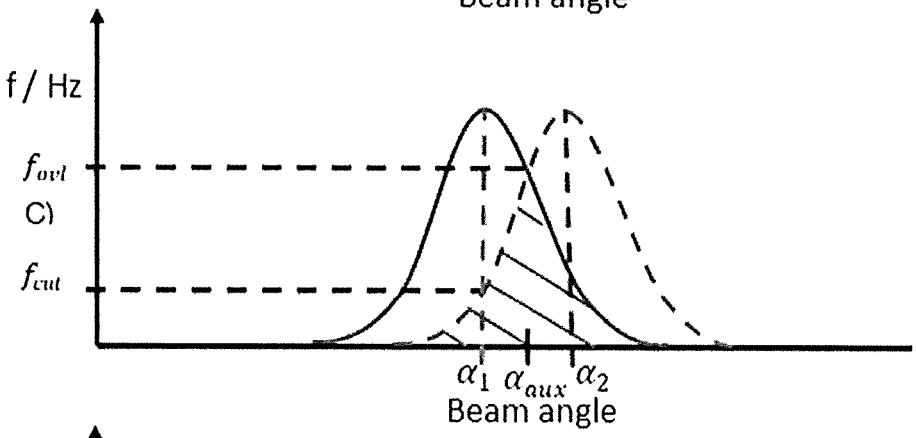

The illustration of FIG. 4C depicts a third scenario, where the difference between the first and second beam directions $\alpha_1$, $\alpha_2$ may be smaller than that of the second scenario to an extent that the first and second beam patterns spatially overlap at audio frequencies below a first threshold frequency $f_{ovl}$ such that the spatial overlap at audio frequencies below a second threshold frequency $f_{cut} \leq f_{ovl}$ encompasses the first beam direction $\alpha_1$ and the second beam direction $\alpha_2$, while the first and second beam patterns are spatially non-overlapping at audio frequencies above the first threshold frequency $f_{ovl}$. Hence, in the third scenario the first beam pattern encompasses the second beam direction $\alpha_2$ and the second beam pattern encompasses the first beam direction $\alpha_1$ at audio frequencies below the second frequency threshold $f_{cut}$. The second threshold frequency $f_{cut}$ is dependent at least on respective shapes of the first and second beam patters and on the difference between the first and second beam directions $\alpha_1$, $\alpha_2$ (e.g. on $|\alpha_1-\alpha_2|$), whereas it may be further dependent on one or both of the first and second beam directions $\alpha_1$, $\alpha_2$ (e.g. on the difference between the first beam direction $\alpha_1$ and the reference direction and/or on the difference between the second beam direction $\alpha_2$ and the reference direction). Along the lines discussed in the foregoing in context of the second scenario, also in the third scenario the spatial overlap below the first threshold frequency $f_{ovl}$ is frequency-dependent, typically such that the extent of spatial overlap decreases with increasing frequency and the spatial overlap at frequency $f<f_{ovl}$ occurs in a range of sound directions from $\alpha_{lo}(f)$ to $\alpha_{hi}(f)$.

Consequently, in the third scenario the audio beamforming procedure in the audio processing entity 120 may be carried out for audio frequencies above the second frequency threshold $f_{cut}$ as described in the foregoing for the second scenario. In other words, the audio beamforming for the sub-range of audio frequencies above the second frequency threshold $f_{cut}$ is carried out separately for the first and second beam directions $\alpha_1$, $\alpha_2$ while applying the compensation procedure to account for the emphasis at audio frequencies between the first threshold frequency $f_{ovl}$ and the second threshold frequency $f_{cut}$ due to the spatial overlap between the first and second beam patterns, thereby mitigating or completely eliminating audio degradation that might otherwise occur in these frequencies. Moreover, the audio beamforming procedure for audio frequencies below the second threshold frequency $f_{cut}$ is carried out using a shared beam pattern directed towards an intermediate beam direction $\alpha_{aux}$ that is between the first and second beam directions $\alpha_1$, $\alpha_2$. The intermediate beam direction $\alpha_{aux}$ may be alternatively referred to as an intermediate sound direction of interest. The intermediate beam direction $\alpha_{aux}$ is selected such that the shared beam pattern directed thereto encompasses both the first beam direction $\alpha_1$ and the second beam direction $\alpha_2$ at audio frequencies below the second threshold frequency $f_{cut}$. As a non-limiting example in this regard, the intermediate beam direction $\alpha_{aux}$ may be at equal distance from the first and second beam directions, e.g. such that $\alpha_{aux}=(\alpha_1+\alpha_2)/2$.

Hence, in the third scenario the audio beamforming procedure may comprise applying the first beam pattern to the multi-channel audio signal 115 at audio frequencies above the second threshold frequency $f_{cut}$ to derive a first audio signal component, applying the second beam pattern to the multi-channel audio signal 115 at audio frequencies above the second threshold frequency $f_{cut}$ to derive a second audio signal component, deriving an intermediate beamformed audio signal as a combination (e.g. as a sum or as an average) of the first and second audio signal components, and applying a compensation procedure to the intermediate beamformed audio signal. Moreover, the audio beamforming procedure in the third scenario may further comprise applying the shared beam pattern to the multi-channel audio signal 115 at audio frequencies below the second threshold frequency $f_{cut}$ to derive a third audio signal component, and deriving the beamformed audio signal 125 as a combination (e.g. as a sum or as an average) of the intermediate beamformed audio signal and the third audio signal component.

In the above description pertaining to the third scenario, the first and second beam patterns implicitly spatially overlap at all audio frequencies below a second threshold frequency $f_{cut}$ such that the spatial overlap encompasses the first and second beam directions $\alpha_1$, $\alpha_2$. However, the third scenario generalizes into one where the spatial overlap that encompasses also the first and second beam directions $\alpha_1$, $\alpha_2$ concerns only some audio frequencies below the second threshold frequency $f_{cut}$ or, conversely, there is no spatial overlap that encompasses also the first and second beam directions $\alpha_1$, $\alpha_2$ in some audio frequencies below the second threshold frequency $f_{cut}$. In such a variation of the third scenario, the shared beam pattern directed to the intermediate beam direction $\alpha_{aux}$ may be applied to those frequencies below the second threshold frequency $f_{cut}$ where spatial overlap that encompasses also the first and second beam directions $\alpha_1$, $\alpha_2$ occurs, whereas those frequencies below the second threshold frequency $f_{cut}$ at which no spatial overlap that encompass also the first and second beam directions $\alpha_1$, $\alpha_2$ occurs are processed as described in the foregoing in context of the third scenario for the audio frequencies above the second threshold frequency $f_{cut}$ (i.e. without application of the shared beam pattern).

Figure 4D:
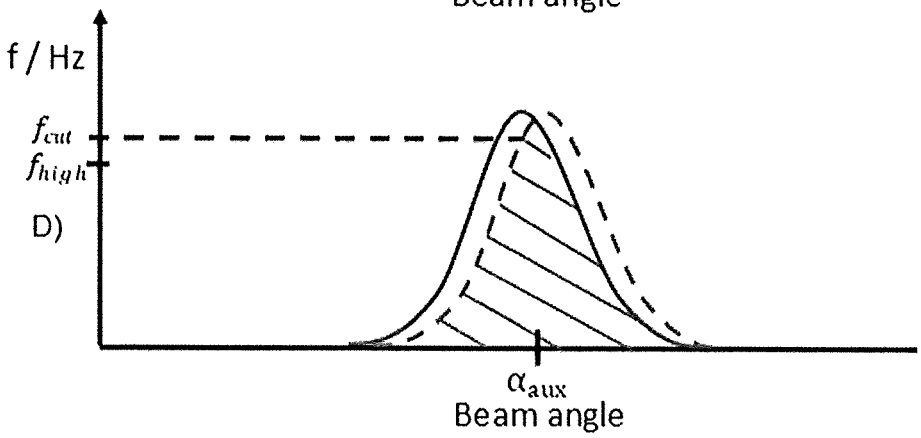

The illustration of FIG. 4D depicts a fourth scenario, where the difference between the first and second beam directions $\alpha_1$, $\alpha_2$ may be yet smaller than that of the third scenario, to the extent that the first and second beam patterns are spatially overlapping each other for the majority of the audio frequencies. As an example in this regard, a pair of first and second beam directions $\alpha_1$, $\alpha_2$ is considered to fall under the fourth scenario when the spatial overlap between the first and second beam patterns encompasses the first beam direction $\alpha_1$ and the second beam direction $\alpha_2$ at least up to a third threshold frequency $f_{high}$. This may be expressed also via the second threshold frequency $f_{cut}$ described in the foregoing in the context of the third scenario, such that the pair of first and second beam directions $\alpha_1$, $\alpha_2$ is considered to fall under the fourth scenario when the second threshold frequency threshold $f_{cut}$ is higher than or equal to the third threshold frequency $f_{high}$, thereby indicating that the spatial overlap between the first and second beam patterns encompasses the first beam direction $\alpha_1$ and/or the second beam direction $\alpha_2$, at least up to the third threshold frequency $f_{high}$. As an example, the third threshold frequency $f_{high}$ may be set to a predefined value selected from a range that is dependent on the number of microphones 112-*k*, on the distances between the microphones 112-*k* and on an intended application of the audio processing arrangement 100 or the audio processing subsystem(s) 100*a*, 110*b*. For a microphone array 112 of a typical mobile-size device, the third threshold frequency may be within a range from 4 to 8 kHz, e.g. 5 kHz.

Consequently, in the fourth scenario the audio beamforming procedure in the audio processing entity 120 may be carried out across audio frequencies using a shared beam pattern directed towards an intermediate beam direction $\alpha_{aux}$ that is between the first and second beam directions $\alpha_1$, $\alpha_2$. In this regard, the intermediate beam direction $\alpha_{aux}$ may be derived or selected along the lines described in the foregoing for the third scenario. In this regard, due to the spatial overlap that also encompasses the first beam direction $\alpha_1$ and the second beam direction $\alpha_2$ for a substantial part of audio frequencies, the shared beam pattern directed to the intermediate beam direction $\alpha_{aux}$ likewise encompasses the first beam direction $\alpha_1$ and the second beam direction $\alpha_2$. Hence, the audio beamforming procedure may comprise applying the shared beam pattern to the multi-channel audio signal 115 across audio frequencies to derive the beamformed audio signal 125.

In a variation of the examples pertaining to the third and fourth scenarios described in the foregoing, instead of finding the second threshold frequency $f_{cut}$ in view of the first and second beam directions $\alpha_1$, $\alpha_2$ as the frequency below which the shared beam pattern is applied for the audio beamforming procedure instead of using the first and second beam patterns, the second threshold frequency $f_{cut}$ may be defined in consideration of spatial overlap area that further takes into account the distance from the microphone array 112 at different frequencies. In this regard, the second threshold frequency $f_{cut}$ may be defined as the highest frequency at which an area (on the horizontal plane) of the spatial audio image encompassed by the overlapping area of the first and second beam patterns is larger than that encompassed by the first beam pattern or larger than that encompassed by the second beam pattern at the same frequency.

In another variation of the examples pertaining to the third and fourth scenarios described in the foregoing, instead of finding the second threshold frequency $f_{cut}$ in view of the first and second beam directions $\alpha_1$, $\alpha_2$ as the frequency below which the shared beam pattern is applied for the audio beamforming procedure instead of using the first and second beam patterns, the second threshold frequency $f_{cut}$ may be defined as the highest frequency at which the range of sound directions encompassed by the shared beam pattern directed towards the intermediate beam direction $\alpha_{aux}$ is larger than the range of sound directions compassed by the first beam pattern or larger than the range of sound directions compassed by the second beam pattern at the same frequency.

The illustrations of FIGS. 5A through 5F further provide a non-limiting conceptual example schematically depicting the frequency dependency of the beam pattern shape. Therein, the illustrations of FIGS. 5A to 5F depict a first beam pattern directed to a beam direction of approximately 30° and a second beam pattern directed to a beam direction of approximately −30° (shown as respective dashed lines) at respective frequencies 352 Hz, 586 Hz, 938 Hz, 1400 Hz, 2100 Hz and 2800 Hz. Through the illustrations of FIGS. 5A to 5F, the first beam pattern is shown as a respective solid curve and the second beam pattern is shown as a respective dashed curve, whereas the illustrations of FIGS. 5A and 5B show the shared beam pattern as a respective dotted curve. As shown in the illustrations of FIGS. 5A through 5F, the respective ranges of sound directions encompassed by the first and second beam patterns get gradually narrower with increasing frequency and, consequently, also the spatial overlap between the first and second beam patterns (in other words, the range or set of sound directions that are included both in the first beam pattern and in the second beam pattern) decreases with increasing frequency.

The audio beamforming procedure that involves deriving the beamformed audio signal 125 based on the multi-channel audio signal 115 in accordance with the first and second beam patterns that correspond to the respective first and second sound directions of interest (or beam directions) $\alpha_1$, $\alpha_2$ described via detailed examples in the foregoing and in the following readily generalizes into any audio focusing procedure that aims at deriving, based on the multi-channel audio signal 115, a processed audio signal in which the first and second sound directions of interest $\alpha_1$, $\alpha_2$ are emphasized in relation to sounds in other sound directions, which audio focusing procedure is carried out in accordance with a first focus pattern that encompasses a first range of sound directions around the first direction of interest $\alpha_1$ and a second focus pattern that encompasses a second range of sound directions around the second direction of interest $\alpha_2$. A non-limiting example of such other audio focusing techniques involves spatial post-filtering, for example according to the procedure(s) described in [1].

Figure 6:
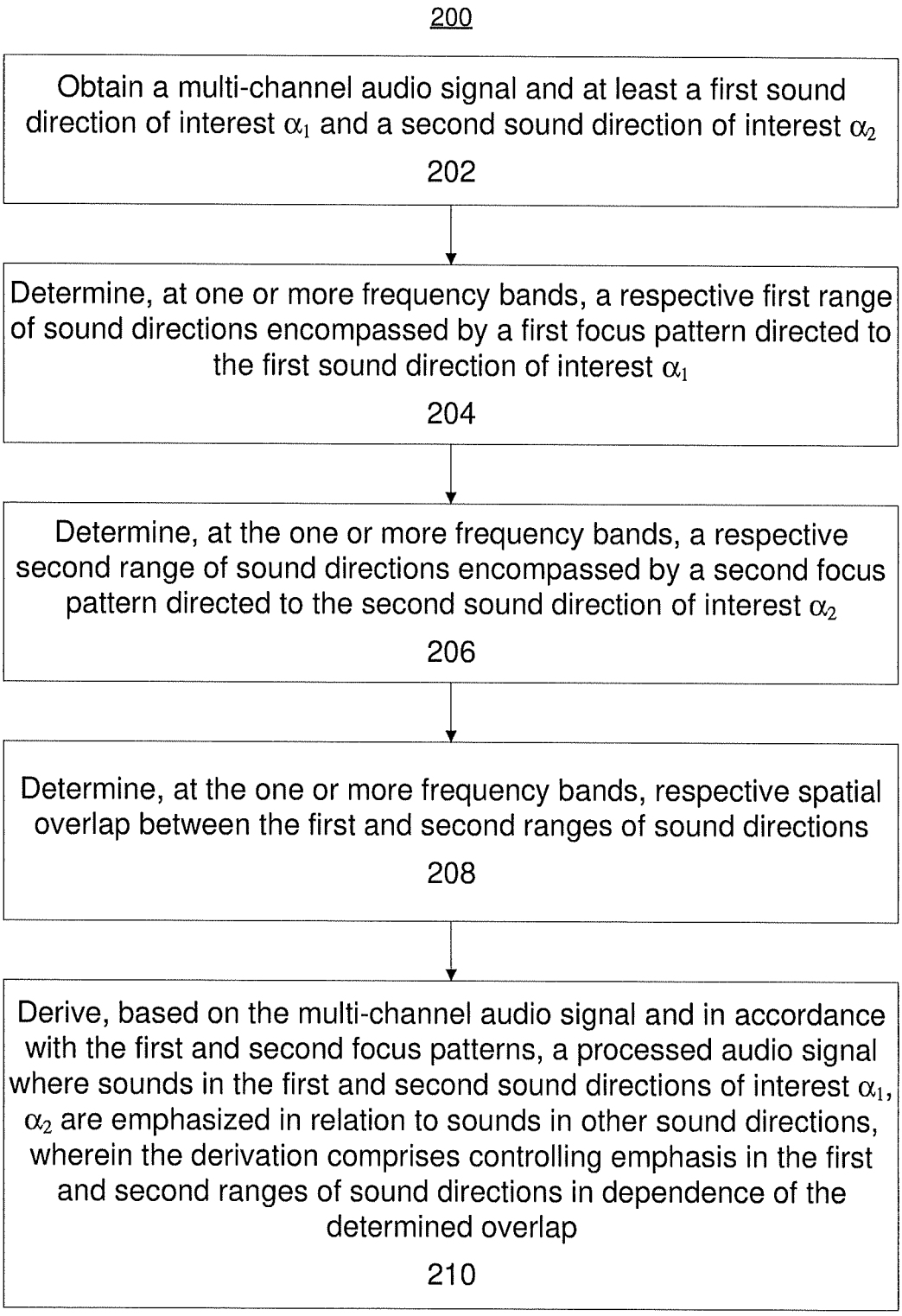
FIG. 6 illustrates a flowchart depicting a method according to an example.

In general, the focusing procedure in the audio processing entity 120 may be carried out, for example, in accordance with a method 200 illustrated in a flowchart of FIG. 6. The operations described with references to blocks 202 to 210 of the method 200 may be varied or complemented in a number of ways without departing from the scope of the audio focusing procedure described in the present disclosure, for example in accordance with the examples described in the foregoing and in the following.

The method 200 facilitates controlled derivation of a processed audio signal that represents sounds in the two or more sound directions of interest. In particular, derivation of the processed audio signal in accordance with the method 200 enables derivation of the processed audio signal 125 such that any audio degradation that might result in straightforward application of respective focus patterns separately for each of the two or more sound directions of interest is mitigated or completely eliminated.

The method 200 commences by obtaining the multi-channel audio signal 115 and at least the first and second sound directions of interest $\alpha_1$, $\alpha_2$, as indicated in block 202. The method 200 further comprises determining, at one or more frequency bands, a respective first range of sound directions encompassed by a first focus pattern directed to the first direction of interest $\alpha_1$, as indicated in block 204, and determining, at the one or more frequency bands, a respective second range of sound directions encompassed by a second focus pattern directed to the second direction of interest $\alpha_2$, as indicated in block 206. The method 200 further comprises determining, at the one or more frequency bands, respective overlap between the first and second ranges of sound directions, as indicated in block 208, and deriving, based on the multi-channel audio signal 115 and in accordance with the first and second focus patterns, the processed audio signal where sounds in first and second directions of interest $\alpha_1$, $\alpha_2$ are emphasized in relation to sounds in other sound directions, wherein the derivation comprises controlling emphasis in the first and second ranges of sound directions in dependence of the determined overlap, as indicated in block 210.

In context of the method 200, the first sound directions of interest $\alpha_1$ may be referred to as a first focus direction and the second sound direction of interest $\alpha_2$ may be referred to as a second focus direction. Consequently, the first focus pattern encompasses, at the one or more frequency bands, respective first range of sound directions around the first focus direction $\alpha_1$ and the second focus pattern encompasses, at the one or more frequency bands, respective second range of sound directions around the second focus direction $\alpha_2$.

In the following we describe various examples pertaining to blocks 202 to 210 via using the audio beamforming procedure as a non-limiting example of audio focusing procedure, the following examples thereby pertaining to derivation of the beamformed audio signal 125 via application of the first and second beam patterns to the multi-channel audio signal 115, where the first beam pattern encompasses, at the one or more frequency bands, respective first range of sound directions around the first focus direction $\alpha_1$ and the second beam pattern encompasses, at the one or more frequency bands, respective second range of sound directions around the second focus direction $\alpha_2$. Therefore, in the following examples the first focus direction $\alpha_1$ is referred to as a first beam direction $\alpha_1$ and the second focus direction $\alpha_2$ is referred to as a second beam direction $\alpha_2$ Further in this regard, in the following examples pertaining to blocks 202 to 210 refer to the overlap between the first and second focus patterns as spatial overlap in order to emphasize that the overlap is considered in the spatial domain (and not e.g. in terms of overlap between frequencies), thereby aiming at improving clarity of the description.

Referring now to operations pertaining to blocks 204 and 206, respective determination of the first range of sound directions and the second range of sound directions may comprise accessing predefined beam pattern information that defines the range of sound directions that fall within a beam pattern directed to a given beam direction and determining the first range of sound directions based on the first sound direction of interest and determining the second range of sound directions based on the second sound direction of interest in accordance with respective definitions available in the beam pattern information.

In one example, the beam pattern information defines the range of sound directions with respect the given beam direction independently of the given beam direction, e.g. such that the same or similar range of sound directions around the given beam direction is defined regardless of the given beam direction. In another example, the beam pattern information defines the range of sound directions with respect to the given beam direction in dependence of the given beam direction, e.g. such that the range of sound directions around the given beam direction may be different for different beam directions. The beam pattern information may define the range of sound directions assigned for a given beam direction as respective absolute sound directions around the given beam direction or as respective difference values that define the extent of the range of sound directions on both sides of the given beam direction.

Moreover, regardless of defining the range of sound directions around a given beam direction in dependence or independently of the given beam direction, the beam pattern information defines the range of sound directions that fall within a beam pattern directed to the given beam direction in dependence of frequency. This may involve defining the range of sound directions separately for one or more frequency bands. In this regard, a frequency range of interest may be a sub-range of frequencies represented by the multi-channel audio signal 115 and/or the beamformed audio signal 125 (e.g. a range of audio frequencies), where the frequency range of interest may be further divided into two or more (non-overlapping) portions sub-portions. In the following, depending on the number sub-portions, the frequency range of interest or a certain sub-portion thereof is referred to as a (respective) frequency sub-band. Hence, in an example there is at least one frequency sub-band, whereas in other examples there is a plurality of frequency sub-bands and the number of frequency sub-bands may be two, three, four or any other number larger than one. In an example, the range of sound directions may be defined separately for a plurality of frequency bins that hence, at least conceptually, may constitute the plurality of frequency sub-bands. Hence, the beam pattern information may define the range of sound directions around a given beam direction as a function of frequency (independently of the given beam direction) or as a function of frequency and the given beam direction.

In case the beam pattern information defines the range of sound directions at least in part in dependence of the given beam direction, the predefined beam pattern information may define a respective range of sound directions for a predefined set of beam directions. The predefined set of beam directions may cover the full range of sound directions (e.g. from −180° to +180° or it may cover a predefined subset of the full range of sound directions (e.g. 'front directions' from −90° to +90°. As a non-limiting example, the predefined set of beam directions may cover the full range of sound directions (or an applicable subset thereof) at regular intervals, e.g. at 5° or 10° intervals or according to a 'grid' of some other kind. The predefined set of beam directions may be selected and/or defined in view of intended usage of the audio processing arrangement 100 or the audio processing sub-system(s) 100*a*, 100*b*, in view of desired granularity of available beam directions and/or in dependence of characteristics of the microphone array 112 applied for capturing the multi-channel audio signal 115 serving as basis for the audio beamforming procedure.

Consequently, in an example, when determining the first and second beam patterns as part of the audio beamforming procedure (e.g. blocks 204 and 206), the method 200 may proceed to identify the predefined beam direction closest to the first sound direction of interest $\alpha_1$ and determine the first range of sound directions as the range of sound directions defined for the identified predefined beam direction (while the range of sound directions encompassed by the second beam pattern may be determined in a similar manner, mutatis mutandis). In another example, the determination of the first and second beam patterns may involve identifying the two predefined beam directions closest to the first sound direction of interest $\alpha_1$ and determining the first range of sound directions as a combination (e.g. as an intersection) of the respective ranges of sound directions defined for the two identified predefined beam directions while the range of sound directions encompassed by the second beam pattern may be determined in a similar manner, mutatis mutandis.

The beam pattern information that defines the range(s) of sound directions around a given beam direction in dependence of frequency and/or in dependence of the given beam direction may be derived, for example, based on (computational) simulations carried out using suitable experimental data and/or based on measurements carried out in suitable field conditions and/or in laboratory conditions. As a non-limiting example, the beam pattern information may be arranged into a beam pattern table that provides a mapping from a frequency to a respective range of sound directions around a given beam direction and/or provides a mapping from a combination of a frequency and a given beam direction to a respective range of sound directions around the given beam direction. Instead of a table, a data structure or function of other type may be applied in defining the range of sound directions around a given beam direction as a function of frequency and/or in defining the range of sound directions around a given beam direction as a function of frequency and the given beam direction.

As a non-limiting example in this regard, Table 1 illustrates a first beam pattern table that defines the mapping between a frequency and a respective range of sound directions.

TABLE 1

| Freq. sub-band | Range of sound directions around a given beam direction $\alpha_k$ |
|---|---|
| Low | $\alpha_k - 30° \ldots \alpha_k + 30°$ |
| Low-mid | $\alpha_k - 20° \ldots \alpha_k + 20°$ |
| Mid-high | $\alpha_k - 10° \ldots \alpha_k + 10°$ |
| High | $\alpha_k$ |

The first beam pattern table considers four frequency sub-ranges, labelled as "low", "low-mid", "mid-high" and "high" with a respective different range of sound directions defined for each of the frequency sub-bands. In the first beam pattern table, the ranges of sound directions are defined via respective difference values that define the extent of the range of sound directions on both sides of the given beam direction. In particular, the first beam pattern table defines a range of sound directions ±30° around the given beam direction for the frequency sub-band "low", a range of sound directions ±20° around the given beam direction for the frequency sub-band "low-mid", and a range of sound directions ±10° around the given beam direction for the frequency sub-band "mid-high", whereas no range of sound directions around the given beam direction is defined for the frequency sub-band "high".

As another non-limiting example, Table 2 illustrates (a portion of) a second beam pattern table that defines the mapping between a combination of a frequency and a given beam direction and a respective range of sound directions. The second mapping table considers a predefined set of beam directions that cover the full range of sound directions (from −180° to +180° at 10° intervals, whereas the Table 2 illustrates only some of the predefined beam directions (i.e. −150°, −90°, −30°, 0°, 30°, 90°, 150° and 180°.

TABLE 2

| | Low | Low-mid | Mid-high | High |
|---|---|---|---|---|
| −150° | −180° . . . −120° | −170° . . . −130° | −160° . . . −140° | −150° |
| −90° | −130° . . . −50° | −120° . . . −60° | −110° . . . −70° | −100° . . . −80° |
| −30° | −60° . . . 0° | −50° . . . −10° | −40° . . . −20° | −30° |
| 0° | −25° . . . 25° | −15° . . . 15° | −5° . . . 5° | 0° |
| 30° | 0° . . . 60° | 10° . . . 50° | 2° . . . 40° | 30° |
| 90° | 50° . . . 130° | 60° . . . 120° | 70° . . . 110° | 80° . . . 100° |
| 150° | 120° . . . 180° | 130° . . . 170° | 140° . . . 160° | 150° |
| 180° | 150° . . . −150° | 160° . . . −160° | 170° . . . −170° | 180° |

The second beam pattern table considers four frequency sub-ranges, labelled as "low", "low-mid", "mid-high" and "high", such that a respective range of sound directions is provided separately for each of these frequency sub-ranges. In the second beam pattern table, the ranges of sound directions are defined as respective absolute ranges of sound directions, whereas in a variation of this example the ranges of sound directions may be defines as respective difference values that define the extent of the range of sound directions on both sides of the given beam direction. Table 2 provides an example where the range of sound directions around a given beam direction may be different depending on the given beam direction, e.g. the range of sound directions around the beam directions −90° and 90° is wider than that around e.g. the beam directions −30°, 0° or 30°. This is, however, a non-limiting aspect of this example and in another examples the difference in the range of sound directions between a pair of beam directions may be different from that exemplified in the second beam pattern table or the ranges of sound directions may be the same or similar around all beam directions.

Referring now to operations pertaining to block 208, determining the spatial overlap between the first and second ranges of sound directions (and hence between the first and second beam patterns) may comprise comparing the first and second ranges of sound directions and determining respective spatial overlap at each frequency sub-band under consideration. Determination of the spatial overlap at a given frequency sub-band may comprise determining one of presence or absence of spatial overlap at the given frequency sub-band, in other words determining whether there are any sound directions that are included both in the first and second ranges of sound directions. Determination of the spatial overlap at a given frequency sub-band may further comprise determining an extent of spatial overlap at the given frequency sub-band. In this regard, the extent of spatial overlap may be defined, for example, as a range (or set) of overlapping sound directions that are included both in the first range of sound directions and in the second range of sound directions at the given frequency sub-band. Determination of the spatial overlap at a given frequency sub-band may further comprise determining whether one or both of the first and second sound directions of interest $\alpha_1$, $\alpha_2$ is encompassed by the range of overlapping sound directions at the given frequency sub-band. Consequently, the spatial overlap determined based on the respective ranges of sound directions encompassed by the first and second beam patterns may comprise one or more of the following pieces of information for each frequency sub-band under consideration:

- a respective indication of one of presence or absence of spatial overlap at the respective frequency sub-band;
- a respective indication of a range of sound directions that are included both in the first range of sound directions and in the second range of sound directions (i.e. a respective range of overlapping sound directions) at the respective frequency sub-band;
- a respective indication of one of inclusion or exclusion of the first sound direction of interest $\alpha_1$ in the range of overlapping sound directions at the respective frequency sub-band;
- a respective indication of one of inclusion or exclusion of the second sound direction of interest $\alpha_2$ in the range of overlapping sound directions at the respective frequency sub-band.

Referring now to operations pertaining to block 210, deriving the beamformed audio signal 125 based on the multi-channel audio signal 115 in accordance with the first and second focus patterns may comprise applying the first and second beam patterns for those frequency sub-bands of the multi-channel audio signal 115 for which no spatial overlap is determined and applying the first and second beam patterns or a shared beam pattern directed to an intermediate beam direction derived based on the first and second sound directions of interest $\alpha_1$, $\alpha_2$ for those frequency sub-bands of the multi-channel audio signal 115 for which spatial overlap is determined. Moreover, controlling the emphasis in the first and second ranges of sound directions may involve applying one of the following approaches in dependence of the spatial overlap determined for the respective one of the one or more frequency sub-bands.

In a first approach, there are no frequency sub-bands for which spatial overlap has been determined, and the derivation of the beamformed audio signal 125 may be carried out separately for the first and second sound directions of interest $\alpha_1$, $\alpha_2$ throughout the frequency sub-bands without the need for controlling the emphasis in the first and second ranges of sound directions. This approach corresponds to the first scenario described in the foregoing with references to FIG. 4A. Consequently, deriving the beamformed audio signal 125 may comprise applying the first beam pattern to the multi-channel audio signal 115 to derive a first audio signal component, applying the second beam pattern to the multi-channel audio signal 115 to derive a second audio signal component, and deriving the beamformed audio signal 125 as a combination (e.g. as a sum or as an average) of the first and second audio signal components.

In a second approach, spatial overlap has been determined for $K_{ovl}$ lowest frequency sub-bands such that the respective range of overlapping sound directions in any of these frequency sub-bands does not include both the first sound direction of interest $\alpha_1$ and the second sound direction of interest $\alpha_2$, and the derivation of the beamformed audio signal 125 may be carried out separately for the first and second sound directions of interest $\alpha_1$, $\alpha_2$ throughout the frequency sub-bands with a respective level compensation applied at the $K_{ovl}$ lowest frequency sub-bands in order to control emphasis in at least some sound directions of the first and second ranges of sound directions at the respective frequency sub-bands. This approach corresponds to the second scenario described in the foregoing with references to FIG. 4B.

Consequently, in the second approach deriving the beamformed audio signal 125 may comprise applying the first beam pattern to the multi-channel audio signal 115 to derive a first audio signal component, applying the second beam pattern to the multi-channel audio signal 115 to derive a second audio signal component, deriving the beamformed audio signal 125 as a combination (e.g. as a sum or as an average) of the first and second audio signal components, and controlling emphasis in at least some sound directions of the first and second ranges of sound directions at the respective frequency sub-bands via applying a level compensation procedure to the beamformed audio signal 125, wherein the level compensation procedure comprises attenuating the beamformed audio signal 125 at the $K_{ovl}$ lowest frequency sub-bands via application of a respective compensation gain having a value that is inversely proportional to the extent of spatial overlap at the respective frequency sub-band.

In a third approach, spatial overlap has been determined for $K_{ovl}$ lowest frequency sub-bands such that the respective range of overlapping sound directions includes the first and second sound directions of interest $\alpha_1$, $\alpha_2$ at $K_{cut}$ lowest frequency sub-bands, where $K_{cut} \leq K_{ovl}$, and the frequency sub-bands of the beamformed audio signal 125 above the frequency sub-band $K_{cut}$ may be derived as described in the foregoing for the second approach, whereas the $K_{cut}$ lowest frequency sub-bands of the beamformed audio signal 125 may be derived via usage of a shared beam pattern directed to an intermediate beam direction $\alpha_{aux}$ derived based on the first and second sound directions of interest $\alpha_1$, $\alpha_2$, which intermediate beam direction $\alpha_{aux}$ is positioned between the first and second sound directions of interest $\alpha_1$, $\alpha_2$ such that the shared beam pattern directed thereto encompasses both the first sound direction of interest $\alpha_1$ and the second sound direction of interest $\alpha_2$ at the $K_{cut}$ lowest frequency sub-bands. In this regard, application of the shared beam pattern in the $K_{cut}$ lowest frequency sub-bands serves to control emphasis in at least some sound directions of the first and second ranges of sound directions at the respective frequency sub-bands As a non-limiting example in this regard, the intermediate beam direction $\alpha_{aux}$ may be at equal distance from the first and second sound directions of interest $\alpha_1$, $\alpha_2$, e.g. such that $\alpha_{aux}=(\alpha_1+\alpha_2)/2$. This approach corresponds to the third scenario described in the foregoing with references to FIG. 4C.

Consequently, in the third approach deriving the frequency sub-bands of the beamformed audio signal 125 above the frequency sub-band $K_{cut}$ may comprise applying the first beam pattern to the respective frequency sub-bands of the multi-channel audio signal 115 to derive a first audio signal component, applying the second beam pattern to the respective frequency sub-bands of the multi-channel audio signal 115 to derive a second audio signal component, deriving the frequency sub-bands of the beamformed audio signal 125 above the frequency sub-band $K_{cut}$ as a combination (e.g. as a sum or as an average) of the first and second audio signal components, and controlling emphasis in at least some sound directions of the first and second ranges of sound directions via applying a compensation procedure to the frequency sub-bands from the frequency sub-band $K_{cut}+1$ to the frequency sub-band $K_{ovl}$ of the beamformed audio signal 125, wherein the compensation procedure comprises attenuating these frequency sub-bands of the beamformed audio signal 125 via application of a respective compensation gain having a value that is inversely proportional to the extent of spatial overlap at the respective frequency sub-band. Moreover, in the third approach controlling emphasis in at least some sound directions of the first and second ranges of sound directions at the respective frequency sub-bands may further comprise deriving the $K_{cut}$ lowest frequency sub-bands of the beamformed audio signal 125 may by applying the shared beam pattern (directed to the intermediate beam direction $\alpha_{aux}$) to the respective frequency sub-bands of the multi-channel audio signal 115.

In a fourth approach, spatial overlap has been determined throughout the frequency sub-bands such that the respective ranges of overlapping sound directions include the first and second sound directions of interest $\alpha_1$, $\alpha_2$, and the beamformed audio signal 125 throughout the frequency sub-bands may be derived using a single beam pattern. In other words, in the fourth approach controlling emphasis in at least some sound directions of the first and second ranges of sound directions may comprise applying the single beam pattern throughout the frequency sub-bands. This approach corresponds to the fourth scenario described in the foregoing with references to FIG. 4D. Consequently, deriving the beamformed audio signal 125 may comprise applying the shared beam pattern directed to the intermediate beam direction $\alpha_{aux}$ to the multi-channel audio signal 115, where the shared beam pattern and the intermediate beam direction $\alpha_{aux}$ may be derived or selected along the lines described in the foregoing for the third approach. In another example, due to the respective ranges of overlapping sound directions including the first and second sound directions of interest $\alpha_1$, $\alpha_2$ throughout the frequency sub-bands, deriving the beamformed audio signal 125 may comprise applying either of the first beam pattern or the second beam pattern to the multi-channel audio signal 115.

Derivation of the beamformed audio signal 125 at different frequencies and/or at different frequency sub-bands and controlling the emphasis in the first and second ranges of sound directions in dependence of the spatial overlap determined therefor in the first, second, third and fourth approaches above generalizes into deriving one or more frequency sub-bands of the beamformed audio signal 125 in dependence of the absence or presence of spatial overlap at a given frequency sub-band and, in case of presence of spatial overlap at a given frequency sub-band, controlling the emphasis in the first and second ranges of sound directions in dependence of inclusion of the first and second sound directions of interest $\alpha_1$, $\alpha_2$ in the range of overlapping sound directions in the given frequency sub-band. In this regard, derivation of a frequency sub-band of the beamformed audio signal 125, including possible control of emphasis in the first and second ranges of sound directions, may comprise, for example, one of the following:

- In case absence of spatial overlap has been determined for a frequency sub-band, derivation of the respective frequency sub-band of the beamformed audio signal 125 may comprise applying the first beam pattern to the respective frequency sub-band of the multi-channel audio signal 115 to derive the respective frequency sub-band for a first audio signal component, applying the second beam pattern to the respective frequency sub-band of the multi-channel audio signal 115 to derive the respective frequency sub-band for a second audio signal component, and deriving the respective sub-band of the beamformed audio signal 125 as a combination of the respective sub-bands of the first and second audio signal components.
- In case presence of spatial overlap has been determined for a frequency sub-band such that either the first sound direction of interest $\alpha_1$ or the second sound direction of interest $\alpha_2$ is not included in the respective range of overlapping sound directions at the respective frequency sub-band, derivation of the respective frequency sub-band of the beamformed audio signal 125 may comprise applying the first beam pattern to the respective frequency sub-band of the multi-channel audio signal 115 to derive the respective frequency sub-band for a first audio signal component, applying the second beam pattern to the respective frequency sub-band of the multi-channel audio signal 115 to derive the respective frequency sub-band for a second audio signal component, deriving the respective sub-band of the beamformed audio signal 125 as a combination of the respective sub-bands of the first and second audio signal components, and controlling the emphasis in at least some sound directions of the first and second ranges of sound directions via applying the level compensation procedure for the respective sub-band of the beamformed audio signal 125, wherein said level compensation procedure comprise attenuating the beamformed audio signal 125 at the respective frequency sub-band by an amount that is inversely proportional to extent of spatial overlap at the respective frequency sub-band.
- In case presence of spatial overlap has been determined for a frequency sub-band such that both the first sound direction of interest $\alpha_1$ and the second sound direction of interest $\alpha_2$ are included in the respective range of overlapping sound directions at the respective frequency sub-band, derivation of the respective frequency sub-band of the beamformed audio signal 125 may comprise controlling the emphasis in at least some sound directions of the first and second ranges of sound directions via determining an intermediate beam direction $\alpha_{aux}$ that is between the first and second sound directions of interest $\alpha_1$, $\alpha_2$, and applying the shared beam pattern that encompasses the first and second sound directions of interest $\alpha_1$, $\alpha_2$ at the respective frequency sub-band and that is directed to said intermediate beam direction $\alpha_{aux}$ to the respective frequency sub-band of the multi-channel audio signal 115 to derive the respective frequency sub-band of the beamformed audio signal 125.

Figure 7:
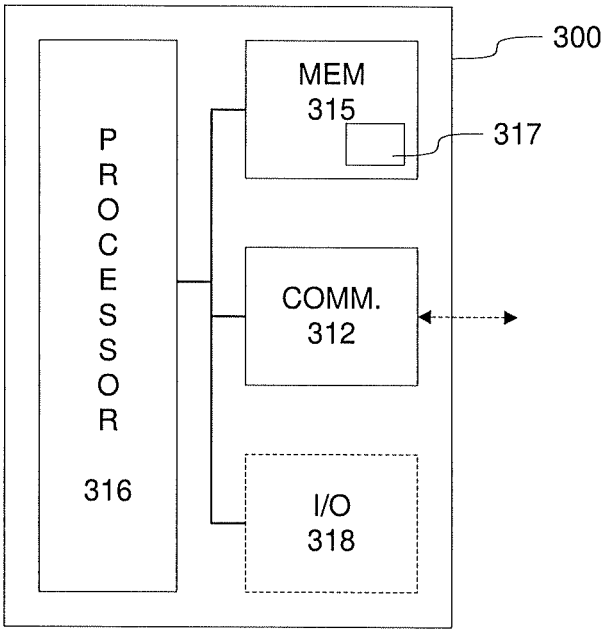
FIG. 7 illustrates a block diagram of some elements of an apparatus according to an example.

FIG. 7 illustrates a block diagram of some components of an exemplifying apparatus 300. The apparatus 300 may comprise further components, elements or portions that are not depicted in FIG. 7. The apparatus 300 may be employed e.g. in implementing one or more components described in the foregoing in context of the audio processing arrangement 100 or in context of one of the audio processing sub-systems 100*a* and 100*b*.

The apparatus 300 comprises a processor 316 and a memory 315 for storing data and computer program code 317. The memory 315 and a portion of the computer program code 317 stored therein may be further arranged to, with the processor 316, to implement at least some of the operations, procedures and/or functions described in the foregoing in context of the audio processing arrangement 100 or in context of one of the audio processing sub-systems 100*a* and 100*b*.

The apparatus 300 comprises a communication portion 312 for communication with other devices. The communication portion 312 comprises at least one communication apparatus that enables wired or wireless communication with other apparatuses. A communication apparatus of the communication portion 312 may also be referred to as a respective communication means.

The apparatus 300 may further comprise user I/O (input/output) components 318 that may be arranged, possibly together with the processor 316 and a portion of the computer program code 317, to provide a user interface for receiving input from a user of the apparatus 300 and/or providing output to the user of the apparatus 300 to control at least some aspects of operation of the audio processing arrangement 100 or some aspects of one of the audio processing sub-systems 100*a* and 100*b* that are implemented by the apparatus 300. The user I/O components 318 may comprise hardware components such as a display, a touchscreen, a touchpad, a mouse, a keyboard, and/or an arrangement of one or more keys or buttons, etc. The user I/O components 318 may be also referred to as peripherals. The processor 316 may be arranged to control operation of the apparatus 300 e.g. in accordance with a portion of the computer program code 317 and possibly further in accordance with the user input received via the user I/O components 318 and/or in accordance with information received via the communication portion 312.

Although the processor 316 is depicted as a single component, it may be implemented as one or more separate processing components. Similarly, although the memory 315 is depicted as a single component, it may be implemented as one or more separate components, some or all of which may be integrated/removable and/or may provide permanent/semi-permanent/dynamic/cached storage.

The computer program code 317 stored in the memory 315, may comprise computer-executable instructions that control one or more aspects of operation of the apparatus 300 when loaded into the processor 316. As an example, the computer-executable instructions may be provided as one or more sequences of one or more instructions. The processor 316 is able to load and execute the computer program code 317 by reading the one or more sequences of one or more instructions included therein from the memory 315. The one or more sequences of one or more instructions may be configured to, when executed by the processor 316, cause the apparatus 300 to carry out at least some of the operations, procedures and/or functions described in the foregoing in context of the audio processing arrangement 100 or in context of one of the audio processing sub-systems 100*a* and 100*b*.

Hence, the apparatus 300 may comprise at least one processor 316 and at least one memory 315 including the computer program code 317 for one or more programs, the at least one memory 315 and the computer program code 317 configured to, with the at least one processor 316, cause the apparatus 300 to perform at least some of the operations, procedures and/or functions described in the foregoing in context of the audio processing arrangement 100 or in context of one of the audio processing sub-systems 100*a* and 100*b*.

The computer programs stored in the memory 315 may be provided e.g. as a respective computer program product comprising at least one computer-readable non-transitory medium having the computer program code 317 stored thereon, the computer program code, when executed by the apparatus 300, causes the apparatus 300 at least to perform at least some of the operations, procedures and/or functions described in the foregoing in context of the audio processing arrangement 100 or in context of one of the audio processing sub-systems 100*a* and 100*b*. The computer-readable non-transitory medium may comprise a memory device or a record medium such as a CD-ROM, a DVD, a Blu-ray disc or another article of manufacture that tangibly embodies the computer program. As another example, the computer program may be provided as a signal configured to reliably transfer the computer program.

Reference(s) to a processor should not be understood to encompass only programmable processors, but also dedicated circuits such as field-programmable gate arrays (FPGA), application specific circuits (ASIC), signal processors, etc. Features described in the preceding description may be used in combinations other than the combinations explicitly described.

Although functions have been described with reference to certain features, those functions may be performable by other features whether described or not. Although features have been described with reference to certain embodiments, those features may also be present in other embodiments whether described or not.

The invention claimed is:

1. A method for audio processing, the method comprising:

obtaining a multi-channel audio signal, a first sound direction of interest and a second sound direction of interest;

determining, for respective ones of one or more frequency bands of the multi-channel audio signal, a first range of sound directions encompassed with a first focus pattern directed to said first sound direction of interest and a second range of sound directions encompassed with a second focus pattern directed to said second sound direction of interest;

determining, for at least one frequency band of said one or more frequency bands, overlap between the first and second ranges of sound directions; and deriving a processed audio signal where sounds in said first and second sound directions of interest are emphasized in relation to sounds in other sound directions, said derivation comprising controlling at least one of the first focus pattern or the second focus pattern in at least one of said first range or said second range of sound directions for the respective ones of the one or more frequency bands in dependence of the determined overlap.

2. A method according to claim 1, wherein determining the first and second ranges of sound directions for the respective ones of the one or more frequency bands comprising determining the first and second ranges of sound directions in dependence of the respective ones of the one or more frequency bands based on predefined focus pattern information that defines a range of sound directions as a function of frequency.

3. A method according to claim 2, wherein the predefined focus pattern information defines the range of sound directions as at least one of:

an extent of the range of sound directions decreases with increasing frequency; or a function of a sound direction of interest and wherein determining the first and second ranges of sound directions comprising at least one of:

determining the first range of sound directions further in dependence of the first sound direction of interest, or determining the second range of sound directions further in dependence of the second sound direction of interest.

4. A method according to claim 1, wherein determining the overlap for the at least one frequency band comprising determining absence or presence of overlap at the respective ones of the one or more frequency bands, and determining, in response to determining the presence of overlap at the at least one frequency band, a range of overlapping sound directions at the at least one frequency band; and deriving the processed audio signal comprising at least one of:

controlling emphasis in one or more sound directions in dependence of the range of overlapping sound directions determined for said at least one frequency band; or at frequency bands for which absence of overlap has been determined, applying the first focus pattern to a respective frequency band of the multi-channel audio signal to derive a respective frequency band for a first audio signal component;

applying the second focus pattern to the respective frequency band of the multi-channel audio signal to derive a respective frequency band for a second audio signal component; and deriving a respective frequency band of the processed audio signal as a combination of the respective frequency bands of the first and second audio signal components.

5. A method according to claim 4, wherein determining the overlap for the at least one frequency band comprising determining, in response to determining the presence of overlap at the at least one frequency band, at least one of:

whether the first sound direction of interest is included in the range of overlapping sound directions at the at least one frequency band, or whether the second sound direction of interest is included in the range of overlapping sound directions at the at least one frequency band; and deriving the processed audio signal comprising controlling the emphasis in the one or more sound directions in dependence of respective inclusion of the first or second sound directions of interest in the range of overlapping sound directions determined for said at least one frequency band.

6. A method according to claim 5, wherein deriving the processed audio signal comprising, at the at least one frequency band for which the presence of overlap has been determined, such that either the first or second sound direction of interest is not included in the range of overlapping sound directions at the at least one frequency band, at least one of:

applying the first focus pattern to the respective frequency band of the multi-channel audio signal to derive the respective frequency band for the first audio signal component;

applying the second focus pattern to the respective frequency band of the multi-channel audio signal to derive the respective frequency band for the second audio signal component;

deriving the respective frequency band of the processed audio signal as the combination of the respective frequency bands of the first and second audio signal components; and wherein controlling the emphasis in the one or more sound directions comprising applying a level compensation procedure for the respective frequency band of the processed audio signal, wherein said level compensation procedure comprising attenuating the processed audio signal at the respective frequency band by an amount that is inversely proportional to extent of overlap at the respective frequency band.

7. A method according to claim 6, wherein said at least one frequency band for which the presence of overlap has been determined, such that either the first or second sound direction of interest is not included in the range of overlapping sound directions comprising at least one of:

a second number of adjacent frequency bands that immediately follow a first number of adjacent frequency bands that represent lowest frequencies among said one or more frequency bands; or the first number of adjacent frequency bands that represent the lowest frequencies among said one or more frequency bands.

8. A method according to claim 5, wherein controlling the emphasis in the one or more sound directions comprising, at the at least one frequency band for which the presence of overlap has been determined such that both the first and second sound directions of interest are included in the range of overlapping sound directions, at least one of:

determining an intermediate sound direction of interest that is between the first and second sound directions of interest; or applying a shared focus pattern that encompasses the first and second sound directions of interest at the at least one frequency band and that is directed to said intermediate sound direction of interest at the respective frequency band of the multi-channel audio signal to derive a respective frequency band of a beamformed audio signal.

9. A method according to claim 8, wherein said at least one frequency band for which the presence of overlap has been determined such that both the first and second sound directions of interest are included in the range of overlapping sound directions consists of a first number of adjacent frequency bands that represent lowest frequencies among said one or more frequency bands.

10. A method according to claim 1, wherein the first focus pattern comprising a first beam pattern, the second focus pattern comprising a second beam pattern, and deriving the processed audio signal comprising applying the first and second beam patterns on the multi-channel audio signal to derive a beamformed audio signal.

11. An apparatus for audio processing, the apparatus comprising at least one processor and at least one non-transitory memory including computer program code, which, when executed with the at least one processor, causes the apparatus to:

obtain a multi-channel audio signal, a first sound direction of interest and a second sound direction of interest;

determine, for respective ones of one or more frequency bands of the multi-channel audio signal, a first range of sound directions encompassed with a first focus pattern directed to said first sound direction of interest and a second range of sound directions encompassed with a second focus pattern directed to said second sound direction of interest;

determine, for at least one frequency band of said one or more frequency bands, overlap between the first and second ranges of sound directions; and derive a processed audio signal where sounds in said first and second sound directions of interest are emphasized in relation to sounds in other sound directions, said derivation comprising controlling at least one of the first focus pattern or the second focus pattern in at least one of said first range or said second range of sound directions for the respective ones of the one or more frequency bands in dependence of the determined overlap.

12. An apparatus according to claim 11, wherein the determined first and second ranges of sound directions for the respective ones of the one or more frequency bands comprising the determined first and second ranges of sound directions in dependence of the respective ones of the one or more frequency bands based on predefined focus pattern information that defines a range of sound directions as a function of frequency.

13. An apparatus according to claim 12, wherein the predefined focus pattern information defines the range of sound directions as at least one of:

an extent of the range of sound directions decreases with increasing frequency; or a function of a sound direction of interest and wherein determining the first and second ranges of sound directions comprising at least one of:

determining the first range of sound directions further in dependence of the first sound direction of interest, or determining the second range of sound directions further in dependence of the second sound direction of interest.

14. An apparatus according to claim 11, wherein determining the overlap for the at least one frequency band comprises the apparatus is caused to determine absence or presence of overlap at the respective ones of the one or more frequency bands, and to determine, in response to the determined presence of overlap at the at least one frequency band, a range of overlapping sound directions at the at least one frequency band; and deriving the processed audio signal comprising the apparatus is caused to at least one of:

control emphasis in one or more sound directions in dependence of the range of overlapping sound directions determined for said at least one frequency band; or at frequency bands for which the absence of overlap has been determined:

apply the first focus pattern to a respective frequency band of the multi-channel audio signal to derive a respective frequency band for a first audio signal component;

apply the second focus pattern to the respective frequency band of the multi-channel audio signal to derive a respective frequency band for a second audio signal component; and derive a respective frequency band of the processed audio signal as a combination of the respective frequency bands of the first and second audio signal components.

15. An apparatus according to claim 14, wherein determining the overlap for the at least one frequency band comprises the apparatus is caused to:

determine, in response to the determined presence of overlap at the at least one frequency band, at least one of:

whether the first sound direction of interest is included in the range of overlapping sound directions at the at least one frequency band; or whether the second sound direction of interest is included in the range of overlapping sound directions at the at least one frequency band; and deriving the processed audio signal comprises the apparatus is caused to control the emphasis in the one or more sound directions in dependence of respective inclusion of the first or second sound directions of interest in the range of overlapping sound directions determined for said at least one frequency band.

16. An apparatus according to claim 15, wherein deriving the processed audio signal comprises, at the at least one frequency band for which the presence of overlap has been determined, such that either the first or second sound direction of interest is not included in the range of overlapping sound directions at the at least one frequency band, the apparatus is further caused to:

apply the first focus pattern to the respective frequency band of the multi-channel audio signal to derive the respective frequency band for the first audio signal component;

apply the second focus pattern to the respective frequency band of the multi-channel audio signal to derive the respective frequency band for the second audio signal component;

derive the respective frequency band of the processed audio signal as the combination of the respective frequency bands of the first and second audio signal components; and wherein controlling the emphasis in the one or more sound directions comprises the apparatus is caused to apply a level compensation procedure for the respective frequency band of the processed audio signal, wherein said level compensation procedure comprises the apparatus is caused to attenuate the processed audio signal at the respective frequency band by an amount that is inversely proportional to extent of overlap at the respective frequency band.

17. An apparatus according to claim 16, wherein said at least one frequency band for which the presence of overlap has been determined such that either the first or second sound direction of interest is not included in the range of overlapping sound directions comprising at least one of:

a second number of adjacent frequency bands that immediately follow a first number of adjacent frequency bands that represent lowest frequencies among said one or more frequency bands; or the first number of adjacent frequency bands that represent the lowest frequencies among said one or more frequency bands.

18. An apparatus according to claim 15, wherein the controlled emphasis in the one or more sound directions causes, at the at least one frequency band for which the presence of overlap has been determined such that both the first and second sound directions of interest are included in the range of overlapping sound directions, the apparatus to at least one of:

determine an intermediate sound direction of interest that is between the first and second sound directions of interest; or apply a shared focus pattern that encompasses the first and second sound directions of interest at the at least one frequency band and that is directed to said intermediate sound direction of interest at the respective frequency band of the multi-channel audio signal to derive a respective frequency band of a beamformed audio signal.

19. An apparatus according to claim 18, wherein said at least one frequency band for which presence of overlap has been determined such that both the first and second sound directions of interest are included in the range of overlapping sound directions consists of a first number of adjacent frequency bands that represent lowest frequencies among said one or more frequency bands.

20. An apparatus according to claim 11, wherein the first focus pattern comprises a first beam pattern, the second focus pattern comprises a second beam pattern, and deriving the processed audio signal comprises causing the apparatus to apply the first and second beam patterns on the multi-channel audio signal to derive a beamformed audio signal.

* * * * *